US006623205B1

(12) United States Patent
Ramirez

(10) Patent No.: US 6,623,205 B1
(45) Date of Patent: Sep. 23, 2003

(54) VEHICLE DISABLING DEVICE

(76) Inventor: Fernando Ramirez, 7609 Webster St., Highland, CA (US) 92346

( * ) Notice: Subject to any disclaimer, the term of this patent is extended or adjusted under 35 U.S.C. 154(b) by 0 days.

(21) Appl. No.: 10/309,742

(22) Filed: Dec. 3, 2002

(51) Int. Cl.[7] ..... E01F 13/12
(52) U.S. Cl. ..... 404/6
(58) Field of Search ..... 404/6

(56) References Cited

U.S. PATENT DOCUMENTS

| | | | | |
|---|---|---|---|---|
| 5,253,950 A | | 10/1993 | Kilgrow et al. | |
| 5,330,285 A | | 7/1994 | Greves et al. | |
| 5,498,102 A | | 3/1996 | Bissell | |
| 5,503,059 A | | 4/1996 | Pacholok | |
| 5,507,588 A | | 4/1996 | Marts et al. | |
| 5,536,109 A | | 7/1996 | Lowndes | |
| 5,611,408 A | | 3/1997 | Abukhader | |
| 5,733,063 A | * | 3/1998 | Bailey et al. | 404/6 |
| 5,839,849 A | | 11/1998 | Pacholok et al. | |
| 5,871,300 A | | 2/1999 | Ingham | |
| 5,921,704 A | | 7/1999 | Pacholok et al. | |
| 6,048,128 A | | 4/2000 | Jones, III et al. | |
| 6,474,903 B1 | * | 11/2002 | Marts et al. | 404/6 |
| 6,527,475 B1 | * | 3/2003 | Lowrie | 404/6 |

FOREIGN PATENT DOCUMENTS

| | | | |
|---|---|---|---|
| FR | 2 605 655 | * | 4/1988 |
| GB | 2 300 660 A | * | 11/1996 |

* cited by examiner

*Primary Examiner*—Gary S. Hartmann
(74) *Attorney, Agent, or Firm*—Eric Karich

(57) ABSTRACT

A vehicle disabling device for disabling a fleeing vehicle has a carriage that is projected from a launch platform using a plurality of elongate extension tubes. The plurality of elongate extension tubes are pneumatically actuated with a tank of compressed air operably connected to the plurality of elongate extension tubes with a pneumatic hose. The carriage includes a pair of carriage wheels and is adapted for rectilinear movement in front of a pursuit vehicle. The carriage also includes a first arm and a second arm connected pivotally to the carriage. A plurality of spikes are disposed along the first and second arms, adapted to puncture the tires of the fleeing vehicle once the fleeing vehicle has run over one of the first and second arms.

6 Claims, 6 Drawing Sheets

VEHICLE DISABLING DEVICE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to vehicle disabling devices, and more particularly to a vehicle disabling device that that can be projected under a fleeing vehicle to deploy spikes to flatten the tires of the fleeing vehicle.

2. Description of Related Art

High-speed vehicular police chases of criminal suspects sometimes result in harm to innocent bystanders, especially in densely populated urban areas. To apprehend a fleeing criminal while minimizing potential danger to bystanders, it is desirable to stop fleeing vehicles before they can cause an accident.

An effective device for stopping the suspect's vehicle must be able to operate across at least a small distance between a pursuit vehicle and the fleeing vehicle. Following represents the state of the art in stopping fleeing vehicles:

Abukhader, U.S. Pat. No. 5,611,408, teaches a device for remotely disabling a vehicle by deflation of the vehicle's tires. The device is mounted on an underside of a pursuit vehicle. A laser light in the device indicates where a projectile expelled by the device will pass. The device is operated by directing the laser light at an underside of a chased vehicle and causing the device to expel the projectile. When the projectile is so expelled, it extends numerous spikes which destroy and deflate the chased vehicle's tires, thereby disabling the chased vehicle and preventing harm to innocent bystanders.

Pacholok et al., U.S. Pat. No. 5,839,849, teaches a mechanical tire deflating device that uses a spring loaded launch tube to launch a folded deflating spike under a fleeing vehicle desired to be stopped. When the mechanical tire deflating device is under the vehicle being pursued, a cable pulls a pin from the folded deflating spike and springs cause a pair of tire deflating spikes to extend and thereby deflate the tires of the pursued vehicle. The above-described references are hereby incorporated by reference in full.

These and similar prior art devices rely on the spikes being shot through the air to hopefully fly under the fleeing vehicle. While a laser can be used to help guide the launch of the spikes, it is entirely up to luck for the spikes to actually go under the fleeing vehicle. Since the chase will likely be at high speed, and involve constant changes in speed and direction, actual success of these devices is questionable.

Worst of all, failure of these prior art device will most likely result in the spikes going under the pursuit vehicle and disabling the pursuit vehicle and perhaps other police cars in the area.

The prior art teaches spike deployment devices that launch a spike deployment device through the air and under a fleeing vehicle to, hopefully, disable the fleeing vehicle. However, the prior art does not teach a vehicle disabling device that is adapted to roll upon at least one wheel, and is projected under the vehicle using a plurality of elongate extension tubes. The present invention fulfills these needs and provides further related advantages as described in the following summary.

SUMMARY OF THE INVENTION

The present invention teaches certain benefits in construction and use which give rise to the objectives described below.

The present invention provides a vehicle disabling device for disabling a fleeing vehicle. The vehicle disabling device includes a means for projecting a carriage from a launch platform. The carriage includes at least one carriage wheel and is adapted for rectilinear movement in front of a pursuit vehicle such as a police vehicle. The carriage also includes a first arm and a second arm connected pivotally to the carriage. A plurality of spikes are disposed along the first and second arms, adapted to puncture the tires of the fleeing vehicle once the fleeing vehicle has run over one of the first and second arms. The vehicle disabling device includes a means for projecting the carriage under the vehicle using a plurality of elongate extension tubes. Once the carriage reaches a predetermined maximum distance, and is under the fleeing vehicle, the vehicle disabling device operates to disable the fleeing vehicle.

A primary objective of the present invention is to provide a vehicle disabling device having advantages not taught by the prior art.

Another objective is to provide a vehicle disabling device that rolls along the ground on at least one carriage wheel, the at least one carriage wheel providing stability and guidance to assure that the carriage is successfully placed under the fleeing vehicle.

A further objective is to provide a vehicle disabling device that remains fixedly attached to the pursuit vehicle so that full control is maintained over the carriage and the plurality of spikes do not inadvertently damage the pursuit vehicle or any other vehicles on the road.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
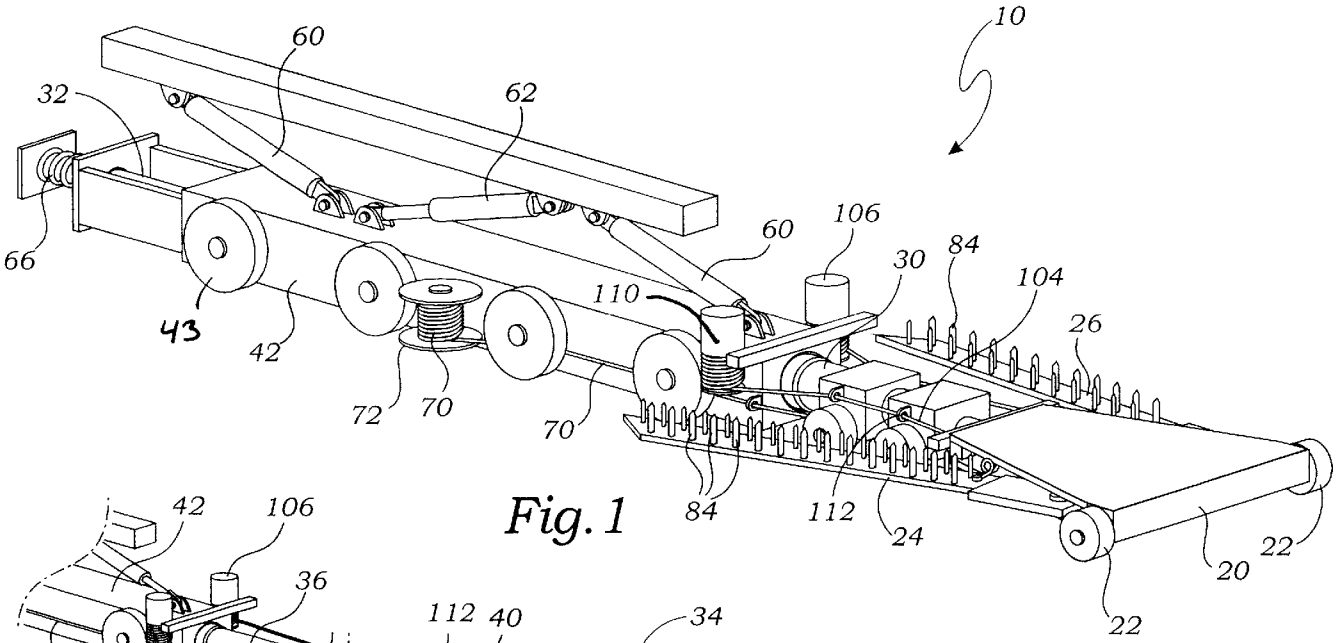
FIG. 1 is a perspective view of a preferred embodiment of a vehicle disabling device having a carriage attached to a launch platform with a plurality of elongate extension tubes, the carriage having first and second arms in a folded position, the plurality of elongate extension tubes being shown in a collapsed configuration.

The above-described drawing figures illustrate the invention, a vehicle disabling device 10 for disabling a fleeing vehicle 12. As illustrated in the above-described drawing figures, the vehicle disabling device 10 includes a means for projecting a carriage 20 from a launch platform 42 for rectilinear movement in front of a pursuit vehicle 14 on at least one carriage wheel 22. Once the carriage 20 reaches a predetermined maximum distance, and is under or in front of the fleeing vehicle 12, the vehicle disabling device 10 operates to extend first and second arms 24 and 26, thereby positioning a plurality of spikes 84 disposed on the first and second arms 24 and 26 to disable the fleeing vehicle 12.

Figure 2:
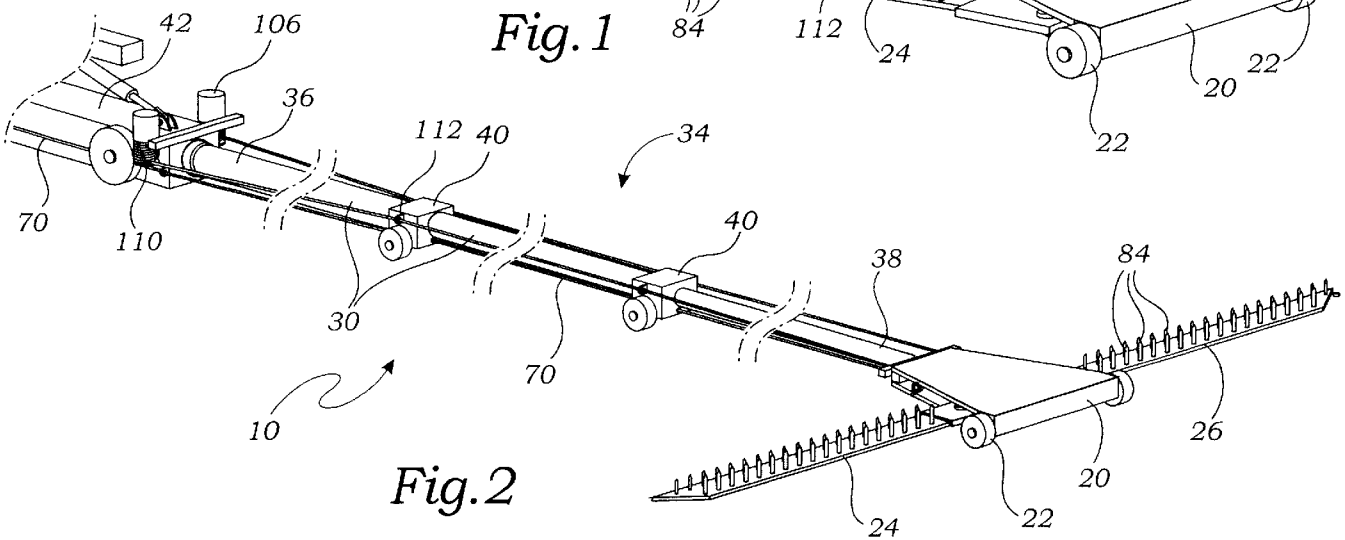
FIG. 2 is a perspective view of the vehicle disabling device once the first and second arms have pivoted to an extended position and the plurality of elongate extension tubes have telescoped to the extended configuration.

In a preferred embodiment, as shown in FIGS. 1 and 2, the means for projecting includes a plurality of elongate extension tubes 30 that attach the carriage 20 to the launch platform 42. The plurality of elongate extension tubes 30 are adapted to telescopically engage each other to move between a collapsed configuration in which the plurality of elongate extension tubes 30 are positioned at least mostly within each other, as shown in FIG. 1, and an extended configuration in which the plurality of elongate extension tubes 30 form an extension arm 34 having a proximal end 36 and a distal end 38, as shown in FIG. 2. The plurality of elongate extension tubes 30 are constructed of rigid and sturdy material such as steel to withstand the strain of projecting the carriage 20.

As shown in FIG. 2, the distal end 38 of the extension arm 34 is adapted to be attached to the carriage 20 and the proximal end 36 is adapted to be attached to the launch platform 42. The distal end 38 is preferably bolted securely to a rear plate 28 (shown in FIG. 8) of the carriage 20. Since the connection between the distal end 38 and the rear plate 28 can be the subject of significant stress, the connection should be secure, strong, and rugged. The plurality of elongate extension tubes 30 are preferably supported with a plurality of trucks 40 for greater stability of the structure.

Figure 3:
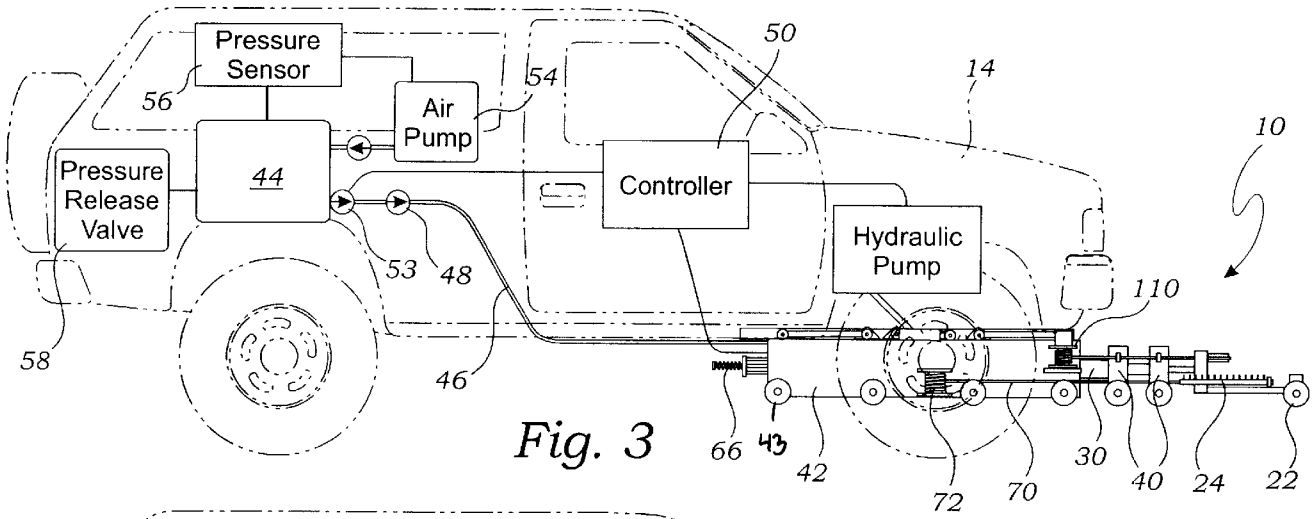
FIG. 3 is a side elevational view of the vehicle disabling device mounted on a pursuit vehicle, the vehicle disabling device being positioned in a raised position.

The launch platform 42 includes a means for extending the plurality of elongate extension tubes 30 from the collapsed configuration to the extended configuration, thereby propelling the carriage 20 on the at least one carriage wheel 22. As shown in FIG. 3, to accomplish the quick projection that is required, the means for extending preferably includes a tank of compressed air 44 operably connected to either the plurality of elongate extension tubes 30 or the launch platform 42 with a pneumatic hose 46. A trigger valve 48 in the pneumatic hose 46, and operably connected to a trigger switch 52 (shown in FIG. 11) of a controller 50, controls the flow of high pressure air through the pneumatic hose 46. The tank of compressed air 44 may be operably connected to an air pump 54 that is responsive to a pressure sensor 56 for maintaining the pressure in the tank of compressed air 44. The tank of compressed air 44 may also include a pressure-release valve 58 to avoid accidental over-pressurization of the tank.

Figure 11:
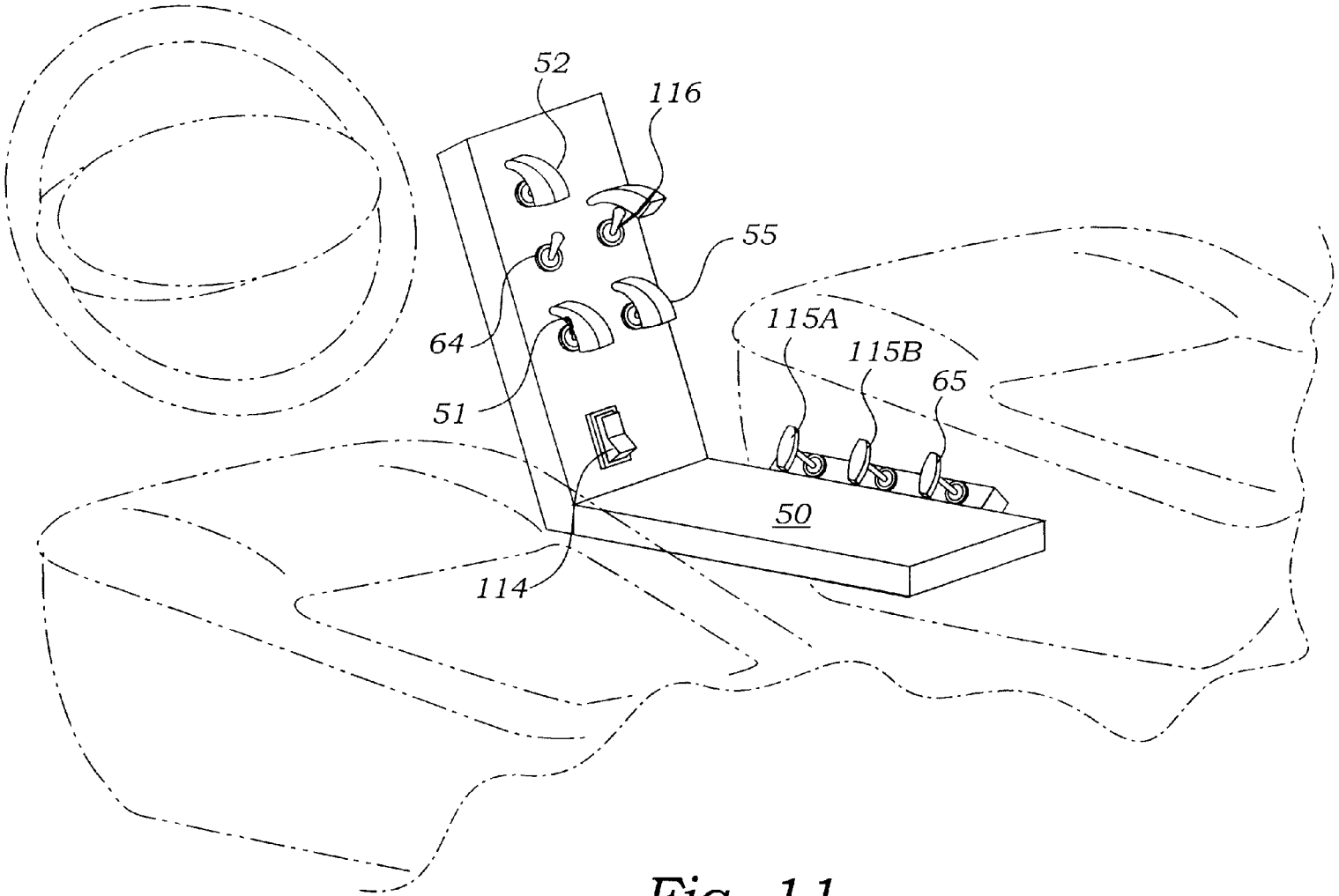
FIG. 11 is a perspective view of a control panel mounted inside the pursuit vehicle.

The controller 50, shown in FIG. 11, is used to operably control the trigger valve 48, along with other features of the vehicle disabling device 10. A master power switch 51 is used to provide power to the vehicle disabling device 10. The trigger switch 52 is used to control the trigger valve 48. A safety valve 53, shown in FIG. 3, is also used to prevent the flow of air through the pneumatic hose 46 until the operator is nearly ready to activate the system. The safety valve 53 is operably controlled by a safety switch 55, shown in FIG. 3, so that the vehicle disabling device 10 cannot be activated until this safety feature has been disabled.

Of course, the means for extending could also be provided by an alternative actuator. Examples of alternative embodiments (not shown) include, but are not limited to, a linear motor, a controlled explosive mechanism as used with air bags and similar applications, or a series of coil springs. Those skilled in the art can devise alternative extending means, and such alternatives should be considered within the scope of the claimed invention.

Figure 4:
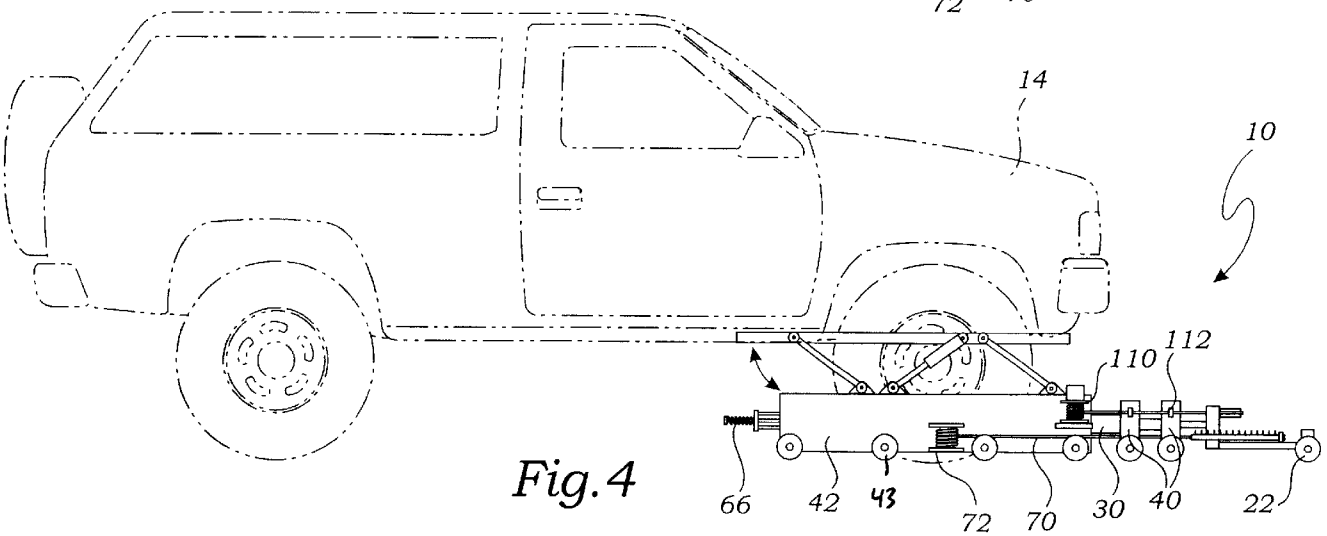
FIG. 4 is a side elevational view thereof illustrating the vehicle disabling device lowered to a lowered position.

As shown in FIGS. 3–4, the launch platform 42 is preferably adapted to be attached to the undercarriage of the pursuit vehicle 14 with lever arms 60 and a hydraulic cylinder 62 that can move the launch platform 42 between a raised position under the pursuit vehicle 14 to a lowered position adjacent the road. The hydraulic cylinder 62 is powered by a hydraulic pump 63 that is operably controlled with a platform control switch 64 (shown in FIG. 11). A safety pin (not shown) is preferably included to prevent the accidental lowering of the launch platform 42, and the safety pin is preferably operably controlled with a pin switch 65. The launch platform 42 is preferably constructed of steel or similar material that is strong and sturdy enough to withstand the rugged use to which the vehicle disabling device 10 is subjected.

As shown in FIG. 3, the launch platform 42 is initially stored in the raised position, supported by the lever arms 60 and the hydraulic cylinder 62 above the ground. The safety pin (not shown) ensures that the launch platform 42 remains in the raised position. When ready for use, the safety pin (not shown) is removed using the pin switch 65 (shown in FIG. 11) and the master power switch 51 is turned on so power is provided. The launch platform 42 is then lowered by switching the platform control switch 64 (shown in FIG. 11) and thereby allowing hydraulic fluid to flow out of the hydraulic cylinder 62 and thereby lower the launch platform to the ground Once the launch platform 42 has been lowered to the lowered position, as shown in FIG. 4, the carriage 20 is also lowered onto the at least one carriage wheel 22 so that it is positioned for use. In the preferred embodiment, the launch platform 42 includes at least one platform wheel 43, most preferably a plurality of wheels, so that the launch platform 42 can roll upon the road surface and over any irregularities. In an alternative embodiment, however, it is also possible for the launch platform 42 to not include the at least one platform wheel 43, and instead for the hydraulic cylinder 62 to simply lower the launch platform 42 to a position that is low enough for use of the carriage 20, but high enough so that the launch platform 42 does not contact the road.

Figure 5:
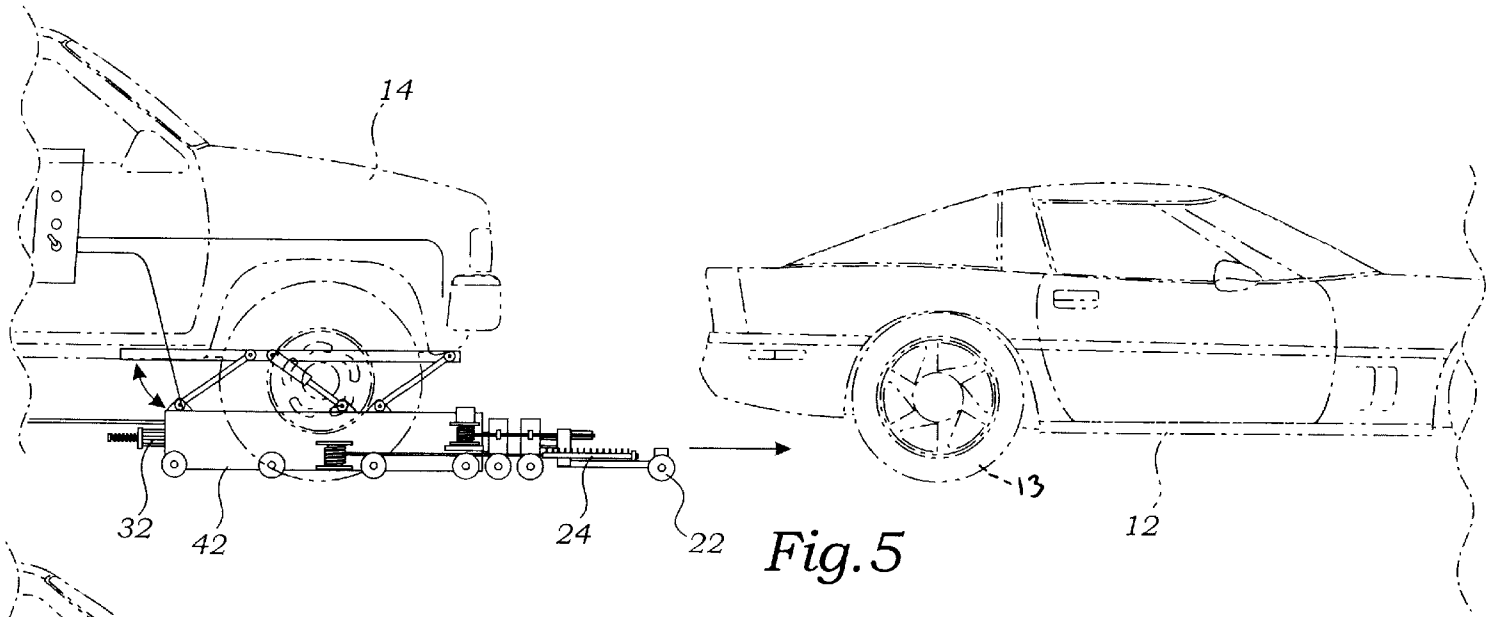
FIG. 5 is a side elevational view thereof once the pursuit vehicle has been positioned behind a fleeing vehicle.
Figure 6:
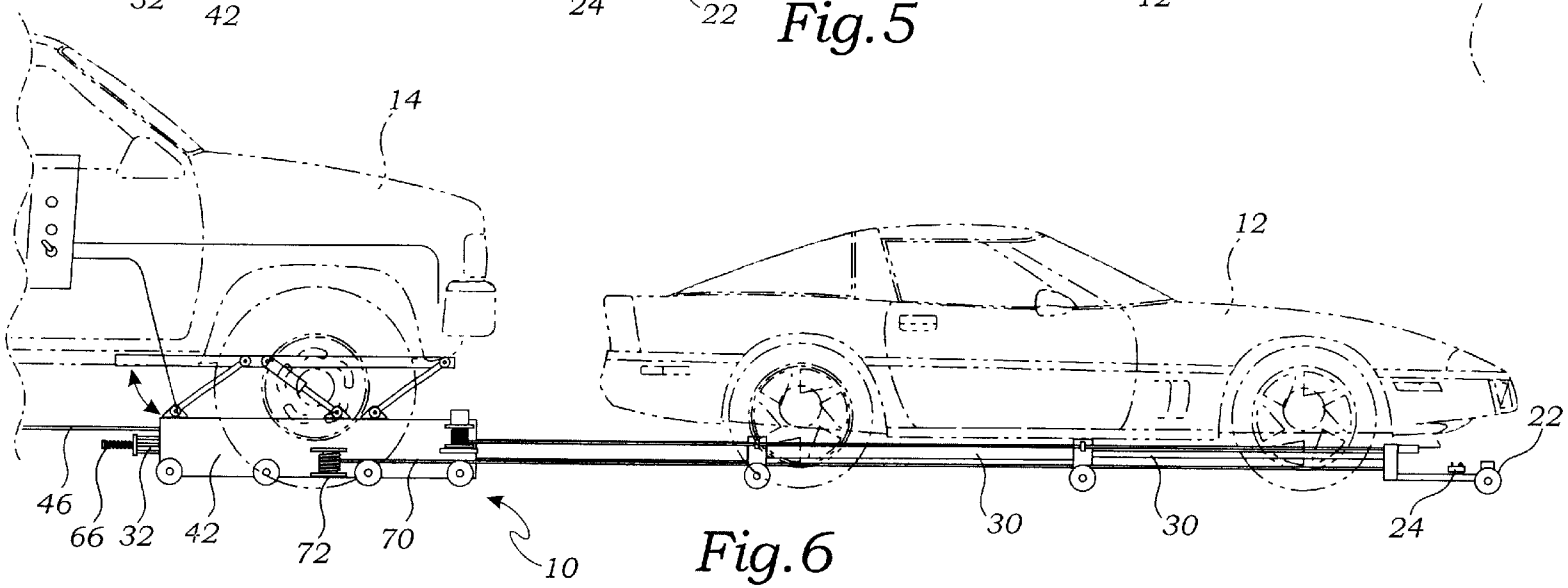
FIG. 6 is a side elevational view thereof illustrating how the carriage is propelled under the fleeing vehicle when the plurality of elongate extension tubes are extended from the collapsed configuration to the extended configuration, and how the first and second arms then move from the folded position to the extended position, thereby positioning the first and second arms to disable the fleeing vehicle.

As shown in FIG. 5, the pursuit vehicle 14 is positioned immediately behind a fleeing vehicle 12 so that the vehicle disabling device 10 is aimed between the tires 13 of the fleeing vehicle 12. Then, as shown in FIG. 6, the means for projecting the carriage 20 is used to propel the carriage 20 under the fleeing vehicle 12, preferably so that the carriage 20 is positioned just in front of the fleeing vehicle 12.

As shown in FIGS. 1, 3, and 4, the launch platform 42 is preferably attached to the first 32 of the plurality of elongate extension tubes 30 through a shock absorption spring 66 such as a coil spring or equivalent mechanism. When the means for extending the plurality of elongate extension tubes 30 is activated to project the carriage 20, and also when the carriage 20 is jerked to a stop by the stop cable 70, the plurality of elongate extension tubes 30 are subjected to a tremendous amount of stress. The shock absorption spring 66 functions to dampen this force and prevent the plurality of elongate extension tubes 30 from being bent or otherwise damaged.

As shown in FIGS. 1, 2, 7, and 8, the at least one carriage wheel 22 is adapted for rectilinear movement of the carriage 20 under or in front of the pursuit vehicle 14. The carriage 20 is short and compact, adapted to fit easily under the pursuit vehicle 14 and the fleeing vehicle 12, and preferably constructed of a strong, rigid material such as steel or similar material. The at least one carriage wheel 22 is preferably a pair of wheels that extend from the sides of the carriage 20 for maximum stability during operations at high speed.

Figure 7:
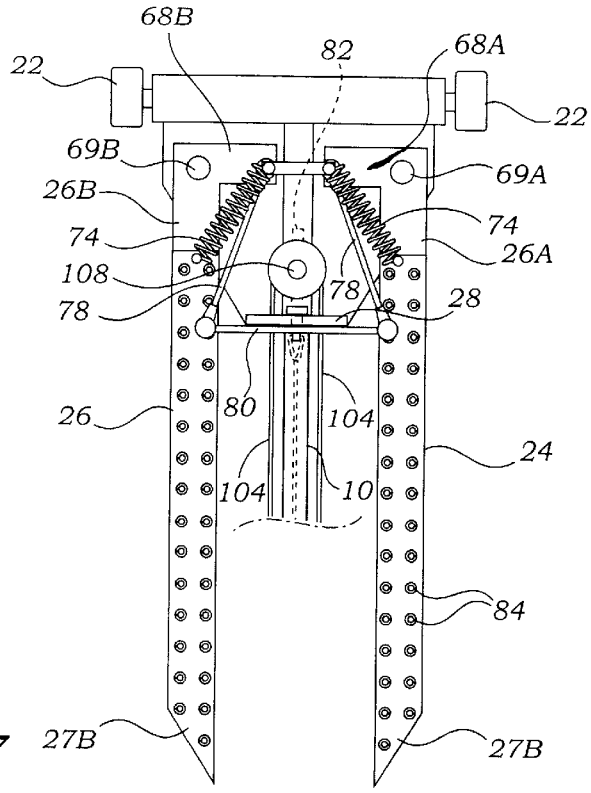
FIG. 7 is a top plan view of the carriage illustrating the first and second arms in the folded position.
Figure 8:
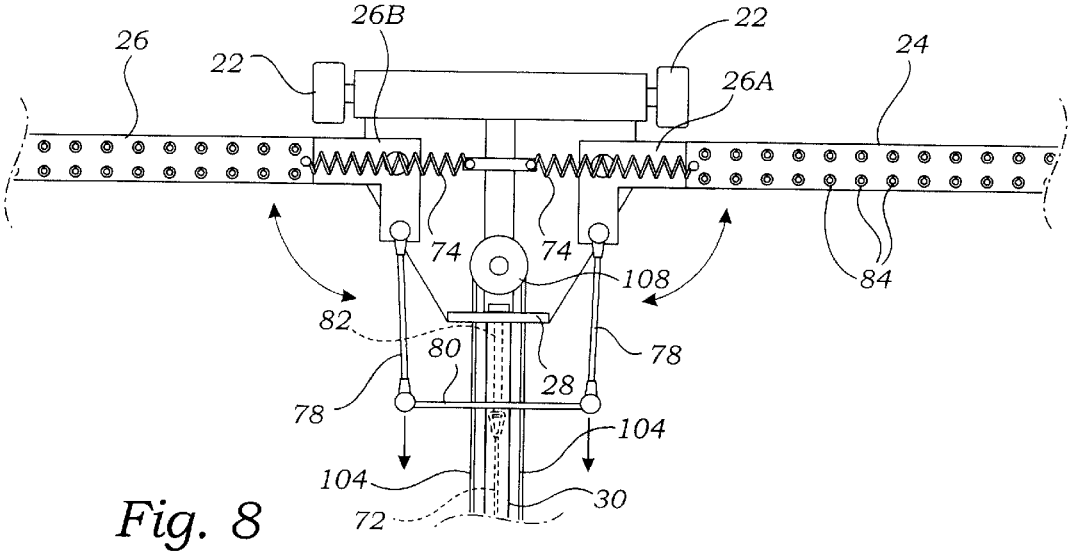
FIG. 8 is a top plan view thereof illustrating the first and second arms in the extended position.

As shown in FIGS. 7 and 8, the first and second arms 24 and 26 are rigid, elongate arms that each extend from first ends 26A and 26B to second ends 27A and 27B. The first and second arms 24 and 26 are each pivotally attached at their first ends 26A and 26B to the carriage 20 with pivot points 69A and 69B. The first and second arms 24 and 26 are initially biased towards a folded position by spring or pair of springs 74. Each of the first and second arms 24 and 26 preferably also each include side-arms 68A and 68B, described below. Once the plurality of elongate extension tubes 30 have been extended to the extended configuration, the first and second arms 24 and 26 pivot to an extended position, thereby enabling a plurality of spikes 84 on the first and second arms 24 and 26 to puncture the tires 13 of the fleeing vehicle 12.

Once the carriage 20 reaches the maximum distance from the pursuit vehicle 14, as described above, the first and second arms 24 and 26 move from a folded position, shown in FIG. 7, to an extended position, shown in FIG. 8, under the control of a means for pivoting the first and second arms 24 and 26. In one embodiment, the means for pivoting may include a stop cable 70 that is adapted to pull the first and second arms 24 and 26 to the extended position once the carriage 20 has been projected the maximum distance.

In the preferred embodiment, as shown in FIGS. 1, 2, 7, and 8, the stop cable 70 is attached to the first and second arms 24 and 26 and to a spool 72 rotatably attached to the launch platform 42. For purposes of this application, when we say that the spool 72 is attached to the launch platform 42, this is defined to include the alternative in which it is attached to the pursuit vehicle 14, or to another structure that moves in cooperation with the pursuit vehicle 14. The first and second arms 24 and 26 are initially positioned in the folded configuration, as shown in FIGS. 1 and 7. As the carriage 20 moves away from the pursuit vehicle 14, the stop cable 70 unwinds from the spool 72 until the carriage 20 reaches the maximum distance, as shown in FIG. 2. When the carriage 20 reaches the maximum distance, the stop cable 70 stops paying out and functions to jerk the first and second arms 24 and 26 to the extended position, as shown in FIG. 8, against the bias of the pair of springs 74. The stop cable 70 can be stopped by any mechanism well known in the art, and is preferably stopped with a cable stop (not shown) that is fixedly attached to the stop cable and has a greater diameter than a stop aperture (not shown) that is fixedly attached to the launch platform 42; the cable stop (not shown) thereby functions to stop the stop cable 70 from extending further than the maximum distance. In the alternative, the stop cable 70 could be strongly and fixedly attached to the spool 72 to prevent the stop cable 70 from coming off of the spool 72, and thereby halting further progress of the carriage 20 once the stop cable 70 is completely unwound from the spool 72. Alternative mechanisms can also be adopted by those skilled in the art, and such obvious or equivalent alternatives should be considered within the scope of the claimed invention.

As shown in FIG. 7, the first and second arms 24 and 26 are preferably biased towards the folded position with the pair of springs 74, described above. The first and second arms 24 and 26 each preferably include side-arms 68A and 68B extending from the first and second arms 24 and 26 adjacent the pivot points 69A and 69B of the first and second arms 24 and 26. A longitudinal arm 78 is pivotally attached to each of the side-arms 68A and 68B of the first and second arms 24 and 26. The longitudinal arms 78 are connected, pivotally, with a lateral arm 80. The stop cable 70 is attached to the lateral arm 80. When the stop cable 70 reaches its maximum length, the stop cable 70 pulls the lateral arm 80, as shown in FIG. 8, to pull the longitudinal arms 78 and the side-arms 68A and 68B, thereby pivoting the first and second arms 24 and 26 to the extended position. A positioning pin 82 preferably extends from the lateral arm 80 into the carriage 20 for guiding the movement of the stop cable 70 and the lateral arm 80.

While the preferred means for pivoting has been described in detail, this should not limit the invention thereto. The scope of the claimed invention should include alternative embodiments and equivalent mechanisms that operate to pivot the first and second arms 24 and 26. For example, a motor mounted on the carriage 20 could be used to motivate the first and second arms 24 and 26 to the extended positions; or a spring mechanism (not shown) could snap the first and second arms 24 and 26 to the extended positions upon the actuation of a remotely controlled release or in response to the carriage 20 reaching the maximum distance and triggering a switch. These and other alternative embodiments that could be devised by those skilled in the art, in light of the teachings of this invention, should be considered within the scope of the claimed invention.

Figure 9:
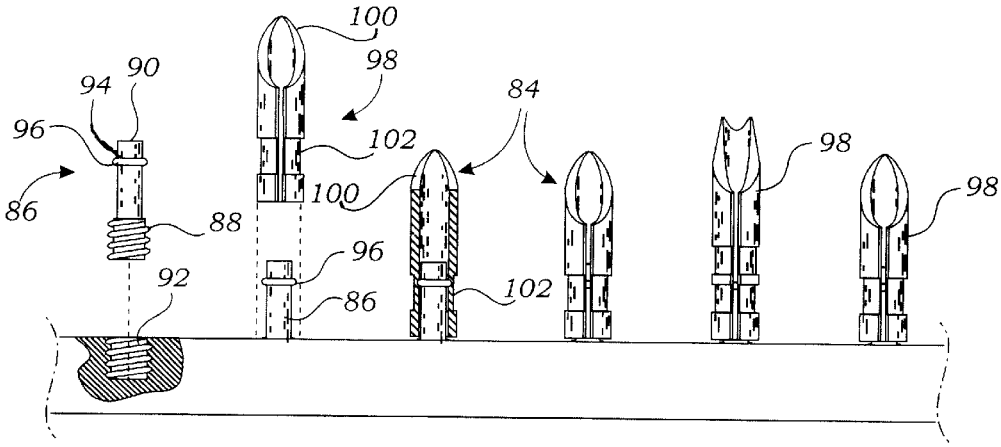
FIG. 9 is a side elevational partially exploded view of the first arm, illustrating a plurality of spikes adapted to be mounted on the first arm.
Figure 10:
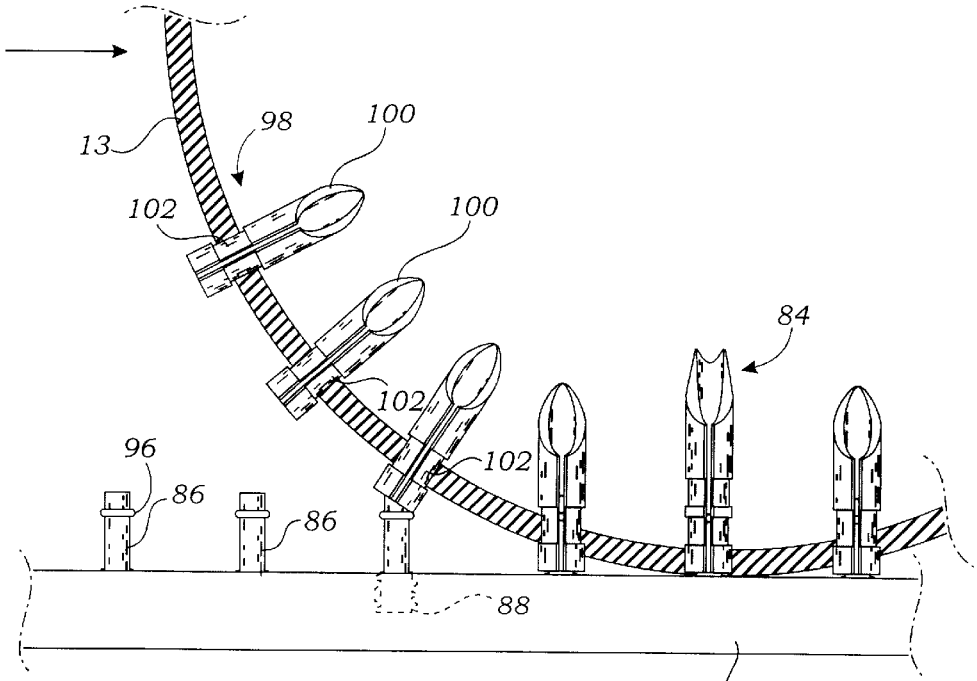
FIG. 10 is a side elevational view thereof illustrating how a tire is deflated by the plurality of spikes.

As shown in FIGS. 9 and 10, the plurality of spikes 84 are disposed along the first and second arms 24 and 26 and adapted to puncture the tires 13 of the fleeing vehicle 12 once the fleeing vehicle 12 has run over one of the first and second arms 24 and 26. Each of the plurality of spikes 84 preferably includes a base 86 and a cylindrical portion 98. The base 86 includes an arm engagement end 88 and a post end 90. The arm engagement end 88 is adapted to engage one of the first and second arms 24 and 26, preferably with an externally thread that is adapted for threadedly engaging an internal thread of one of a plurality of apertures 92 in one of the first and second arms 24 and 26. The post end 90 ispreferably includes an annular groove 94 adapted to receive an O-ring 96.

The cylindrical portion 98 preferably includes a sharp end 100 and an annular tire gripping groove 102. The cylindrical portion 98 is preferably generally cylindrical in shape and is adapted to fit over the post end 90 and frictionally engage the O-ring 96 such that the sharp end 100 is pointed upwards. When the fleeing vehicle 12 runs over the first and second arms 24 and 26, as shown in FIG. 10, the tire 13 of the fleeing vehicle 12 is punctured by at least one of the plurality of spikes 84 such that the tire 13 becomes frictionally locked around the tire gripping groove 102. The tire gripping groove 102 functions to position the cylindrical portion 98 through the tire 13 and allow air to escape from the tire 13 through the cylindrical portion 98. The cylindrical portion 98 is able to easily pull off the post end 90 due to the resilience of the O-ring 96. Grease (not shown) can be applied to the post end 90 to both make the initial fit more secure, and to also facilitate the cylindrical portion 98 coming off the post end 90 during use.

The vehicle disabling device 10 further includes a means for retracting the carriage 20 once the fleeing vehicle 12 has been disabled. As shown in FIGS. 1–4, in the preferred embodiment the means for retracting includes a retraction cable 104 that preferably extends from a first winch 106 mounted on the launch platform 42, around a pulley 108 mounted on the carriage 20, to a second winch 110 mounted on the launch platform 42. The first winch 106 and the second winch 110 together function to pull in the retraction cable 104 and thereby pull the carriage 20 from the extended configuration to the collapsed configuration. The retraction cable 104 preferably passes through cable guides 112 mounted on each of the plurality of trucks 40 to prevent the retraction cable 104 from becoming tangled, or from wearing against the surface of the road during use.

The means for retracting is preferably actuated with a retraction switch 114, shown in FIG. 11. While the preferred embodiment includes two winches 106 and 110, it is also possible that only a single winch or equivalent retraction motor if a slower retraction is allowed. Alternative embodiments of the preferred embodiment can also be utilized.

Method of Use

The vehicle disabling device 10 described above enables a method for disabling the fleeing vehicle 12 that minimizes danger to the pursuit vehicle 14 and to innocent bystanders. The above-described device 10 is initially configured with the first and second arms 24 and 26 in the folded position, the extension arm 34 in the collapsed configuration, and the launch platform 42 in the raised position, as shown in FIG. 3. The launch platform 42 is attached to the underside of the pursuit vehicle 14. In this configuration, the vehicle disabling device 10 is supported off the ground, and the pursuit vehicle 14 can be driven without interference from the vehicle disabling device 10.

In use, the operator lowers the launch platform 42 to the lowered position onto the ground so that it rolls upon the at least one platform wheel 43, as shown in FIG. 4 and as described above. This is preferably accomplished by lowering the pair of lever arms 60, either with the hydraulic cylinder 62, manually, or with a remotely actuated motor or similar actuator. This also lowers the carriage 20 onto the at least one carriage wheel 22, so it is ready for use.

The operator then positions the pursuit vehicle 14 directly behind the fleeing vehicle 12, as shown in FIG. 5, and actuates the means for projecting the carriage 20. In the preferred embodiment, the operator first switches the safety switch 55, shown in FIG. 11, to open the safety valve 53 to allow air to flow through the pneumatic hose 46, as shown in FIG. 3. The operator also actuates winch releases 115A and 115B, shown in FIG. 11, to put the first and second winches 106 and 110, shown in FIG. 1, into neutral so that the retraction cable 104 can play out of the winches 106 and 110. The operator then uses the trigger switch 52, shown in FIG. 11, to trigger the trigger valve 48, thereby allowing compressed air from the tank of compressed air 44 to actuate the plurality of elongate extension tubes 30 from the collapsed configuration to the extended configuration, driving the carriage 20 under the fleeing vehicle 12 or even in front of the fleeing vehicle 12, as shown in FIG. 6. The entire action only takes a moment due to the power of the pneumatic system, so there is no opportunity for the fleeing vehicle 12 to take evasive action.

As the carriage 20 moves away from the pursuit vehicle 14, the stop cable 70 unreels from the spool 72 and does not trigger the extension of the first and second arms 24 and 26. Once the carriage 20 has reached the maximum distance and the plurality of elongate extension tubes 30 have reached the extended configuration, the stop cable 70 becomes fully extended and functions to pull the first and second arms 24 and 26 from the folded position to the extended position. At this point, the plurality of spikes 84 are operably positioned to disable the fleeing vehicle 12. At the moment that the vehicle disabling device 10 is fully deployed, the pursuit vehicle 14 can immediately brake and thereby cause the fleeing vehicle 12 to run over the plurality of spikes 84, thereby disabling the fleeing vehicle 12 without danger to the pursuit vehicle 14 or to bystanders.

After the use of the vehicle disabling device 10, the trigger switch 52 and the safety switch 55 (shown in FIG. 11) are returned to their off positions and the air release switch 116 (shown in FIG. 11), is used to release air from the extension arm 34 through a release valve (not shown). Once the air pressure is released, a retraction switch 114 is used to activate the first and second winches 106 and 110 retract the carriage 20 to the collapsed configuration. The springs 74 function to return the first and second arms 24 and 26 to their folded position. Finally, the hydraulic cylinder 62 or similar motor or actuator can be used to raise the launch platform 42, and the pursuit vehicle 14 is able to drive away until it is needed again. At any time that the tank of compressed air 44 loses pressure, either due to use or leakage, the air pump 54 is able to recharge the tank of compressed air 44 automatically.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A vehicle disabling device comprising:

a carriage having at least one carriage wheel;

an elongated first arm and an elongated second arm, each of the first and second arms having a first end and a second end, the first end of the first arm and the first end of the second arm being connected pivotally to the carriage;

a plurality of spikes disposed along the first and second arms;

a plurality of elongate extension tubes adapted to telescopically engage each other to move between a collapsed configuration in which the plurality of elongate extension tubes are positioned at least mostly within each other, and an extended configuration in which the plurality of elongate extension tubes form an extension arm having a proximal end and a distal end, the distal end of the extension arm being adapted to be attached to the carriage;

a launch platform adapted to be attached to the proximal end of the extension arm, the launch platform having a means for extending the plurality of elongate extension tubes from the collapsed configuration to the extended configuration, thereby propelling the carriage on the at least one carriage wheel; and a means for pivoting each of the first and second arms from a folded position to an extended position once the plurality of elongate extension tubes are in the extended configuration.

2. The vehicle disabling device of claim 1 wherein the means for extending includes a tank of compressed air operably connected to the launch platform with a pneumatic hose for extending the plurality of elongate extension tubes from the collapsed configuration to the extended configuration.

3. The vehicle disabling device of claim 1 wherein the means for pivoting includes the following:

a spool rotatably mounted on the launch platform; and a stop cable wound upon the spool and operable attached to the first and second arms such that, when the plurality of elongate extension tubes are fully extended, the cable pulls the first and second arms from the folded position to the extended position.

4. A method for disabling a fleeing vehicle, the method comprising the steps of:

a) providing a vehicle disabling device that includes a carriage having at least one carriage wheel;

an elongated first arm and an elongated second arm, each of the first and second arms having a first end and a second end, the first end of the first arm and the first end of the second arm being connected pivotally to the carriage;

a plurality of elongate extension tubes that are adapted to telescopically engage each other to move between a collapsed configuration in which the plurality of elongate extension tubes are positioned at least mostly within each other, and an extended configuration in which the plurality of elongate extension tubes form an extension arm having a proximal end and a distal end, the distal end of the extension arm being adapted to be attached to the carriage; and a plurality of spikes disposed along the first and second arms;

b) projecting the carriage so that it rolls under the fleeing vehicle;

c) pivoting the first and second arms of the vehicle disabling device from a folded position to a extended position, such that the fleeing vehicle drives over the plurality of spikes and is disabled.

5. The method of claim 4 wherein the vehicle disabling device further includes a launch platform adapted to be attached to the proximal end of the extension arm, the launch platform having a means for extending the plurality of elongate extension tubes from the collapsed configuration to the extended configuration.

6. The method of claim 5 wherein the means for extending includes a tank of compressed air operably connected to the plurality of elongate extension tubes with a pneumatic hose for extending the plurality of elongate extension tubes from the collapsed configuration to the extended configuration.

* * * * *